US008789909B2

(12) United States Patent
Shimizu

(10) Patent No.: US 8,789,909 B2
(45) Date of Patent: Jul. 29, 2014

(54) INK JET RECORDING APPARATUS

(75) Inventor: Masashi Shimizu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 289 days.

(21) Appl. No.: 13/030,931

(22) Filed: Feb. 18, 2011

(65) Prior Publication Data

US 2011/0205279 A1 Aug. 25, 2011

(30) Foreign Application Priority Data

Feb. 25, 2010 (JP) ..... 2010-039728

(51) Int. Cl.
*B41J 29/38* (2006.01)

(52) U.S. Cl.
USPC ..... 347/16; 347/101; 347/104

(58) Field of Classification Search
USPC ..... 347/4, 8, 16, 44, 104, 14, 101; 83/440
See application file for complete search history.

(56) References Cited

U.S. PATENT DOCUMENTS

| | | | | |
|---|---|---|---|---|
| 2005/0231578 | A1* | 10/2005 | Tajima | 347/104 |
| 2006/0007292 | A1* | 1/2006 | Ohmori et al. | 347/104 |
| 2006/0086223 | A1* | 4/2006 | Kaneko et al. | 83/440 |
| 2006/0221166 | A1* | 10/2006 | Inoue | 347/104 |

FOREIGN PATENT DOCUMENTS

| | | | | |
|---|---|---|---|---|
| JP | 63-163458 | A | 7/1988 | |
| JP | 2002-127519 | A | 5/2002 | |
| JP | 2004-074710 | A | 3/2004 | |
| JP | 2004-074710 | A | 3/2004 | |
| JP | 2004-074710 | * | 11/2004 | ..... B41J 11/42 |
| JP | 2005-015132 | A | 1/2005 | |
| JP | 2005-15132 | A | 1/2005 | |
| JP | 3951858 | B2 | 8/2007 | |

* cited by examiner

*Primary Examiner* — Manish S Shah
*Assistant Examiner* — Yaovi Ameh
(74) *Attorney, Agent, or Firm* — Canon USA, Inc., IP Division

(57) ABSTRACT

An ink jet recording apparatus includes a recording head configured to discharge ink onto a recording medium, a carriage on which the recording head is mounted and which is configured to make a reciprocating movement, a cutter unit mounted on the carriage and configured to cut the recording medium, a detection unit mounted on the carriage and configured to detect a distance to the recording medium, and a control unit configured to control an operation of the recording apparatus. The ink jet recording apparatus includes a first process for detecting an amount of a change in the distance to the recording medium by the detection unit when the recording medium is cut by the cutter unit, and a second process for detecting the distance to the recording medium by the detection unit while the cutter unit is retracted if the change amount equal to or more than a predetermined value is detected in the first process. The control unit determines that the state of the recording medium is abnormal when the distance to the recording medium detected in the second process is equal to or less than a predetermined value.

14 Claims, 16 Drawing Sheets

FIG.12

| | ~ 10°C | 11°C ~ 20°C | 21°C ~ 30°C | 31°C ~ 40°C | 41°C ~ |
|---|---|---|---|---|---|
| SHEET 1 | 100 | 100 | 100 | 100 | 100 |
| SHEET 2 | 100 | 90 | 80 | 90 | 100 |
| SHEET 3 | 80 | 70 | 70 | 80 | 80 |
| SHEET 4 | 80 | 60 | 60 | 60 | 70 |

INK JET RECORDING APPARATUS

BACKGROUND OF THE INVENTION

1. Field of the Invention

The present invention relates to an ink jet recording apparatus in which a carriage configured to move along a recording medium is equipped with a detection unit capable of detecting whether the recording medium is in an abnormal state by detecting a distance to the recording medium.

2. Description of the Related Art

As one type of recording apparatus such as a printer, a facsimile, a copying machine for recording an image based on image information on a sheet-shaped recording medium such as paper, there is an ink jet recording apparatus which records an image by discharging ink from a recording head onto a recording medium. A typical ink jet recording apparatus is a serial-type ink jet recording apparatus including a recording head mounted on a carriage capable of reciprocating in a main scanning direction intersecting with a conveying direction of recording medium, and performing a recording operation by discharging ink from the recording head in synchronization with a movement of the carriage. In this serial-type recording method, recording on an entire recording medium is performed by alternately repeating a recording operation of recording one line while the carriage is being moved, and a conveyance operation of conveying the recording medium by a predetermined pitch. Examples of recording medium include a cut sheet divided into a predetermined size, and a continuous sheet such as roll paper. A recording apparatus using a continuous sheet cuts the continuous sheet at the rear end of a recorded image of a predetermined amount by a cutter unit, and discharges the portion of the sheet with the image recorded thereon.

If abnormal conveyance such as sheet uplift occurs at the time of conveyance of a recording medium through a recording unit, this may result in incorrect recording on the recording medium. For example, some types (characteristics) of recording medium or some conditions of ambient environment such as a temperature and humidity may cause a cutter unit to be caught by a recording medium when the cutter unit cuts the recording medium, which may lead to sheet uplift, then resulting in generation of a scrape between the recording head and the recording medium. If the sheet uplift is significant enough to apply a large load to the carriage and cutter, the recording operation is immediately stopped to prevent the recording head from being heavily damaged. However, in some cases, sheet uplift only slightly increases the load applied to the carriage and the cutter, while scrapes of the recording head are being accumulated. In such a case, this abnormality cannot be distinguished from a load fluctuation in a normal cutting operation, so that the scrape of the recording head cannot be detected. Then, if the recording head is repeatedly damaged from the scrapes, not only correct recording may become impossible but also the recording head may be broken.

Japanese Patent Application Laid-Open No. 2005-015132 discusses a technique of determining an abnormality in a recording medium being conveyed based on a detection result about the width of the recording medium and the distance from the recording medium to a recording head with use of a distance measurement sensor capable of detecting the distance from the recording head on a carriage to the recording medium. Further, Japanese Patent Application Laid-Open No. 2004-074710 discusses a technique of detecting the distance to a recording medium and the width of the recording medium with use of a sensor mounted on a carriage to detect an abnormality in the recording medium being conveyed based on the detection result.

However, since the technique discussed in Japanese Patent Application Laid-Open No. 2005-015132 is a method of detecting a flap on a tractor apparatus on which the edges of a continuous sheet on the both sides are placed, this technique can detect only a sheet uplift state at the edges of the sheet on the both sides, and therefore cannot detect a sheet uplift state at the center position of the sheet. On the other hand, the technique discussed in Japanese Patent Application Laid-Open No. 2004-074710 detects an abnormal state at an arbitrary position or a plurality of positions of a sheet with use of the distance measurement sensor mounted on the carriage. Then, this technique immediately determines that the conveyance state is abnormal when the detection result exceeds a predetermined range. These features of the method discussed in Japanese Patent Application Laid-Open No. 2004-074710 lead to the following problems. When an abnormal state such as sheet uplift is searched at a plurality of positions or in the entire region of a sheet prior to a printing operation, a sheet having a large size increases a time spent on detection movement of the carriage, thereby reducing the throughput even when the conveyance is in a normal state. Further, even though detection is performed by moving the carriage during cutting of a sheet to prevent a reduction in the throughput, since the sheet changes its posture relative to the carriage, output of the sensor fluctuates, thereby reducing the detection accuracy. Further, although sheet uplift may be alleviated through a sheet push-out operation, sheet uplift is searched at a position where the sheet behaves differently from the time of printing, thereby reducing the detection accuracy. As a result, even conveyance that is not abnormal may be determined as a conveyance failure.

SUMMARY OF THE INVENTION

The present invention is directed to an ink jet recording apparatus using an easy method for preventing a recording failure due to an abnormal state by accurately detecting whether a conveyance state of a recording medium is abnormal while maintaining throughput of a recording operation.

According to an aspect of the present invention, an ink jet recording apparatus includes a recording head configured to discharge ink onto a recording medium, a carriage on which the recording head is mounted and which is configured to make a reciprocating movement, a cutter unit mounted on the carriage and configured to cut the recording medium, a detection unit mounted on the carriage and configured to detect a distance to the recording medium, and a control unit configured to control an operation of the recording apparatus. The ink jet recording apparatus includes a first process for detecting an amount of a change in the distance to the recording medium by the detection unit when the recording medium is cut by the cutter unit, and a second process for detecting the distance to the recording medium by the detection unit while the cutter unit is retracted if the change amount equal to or more than a predetermined value is detected in the first process. The control unit determines that the state of the recording medium is abnormal when the distance to the recording medium detected in the second process is equal to or less than a predetermined value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 12 is a table indicating an example of the relationship between a suction force applied to a conveyance surface of a platen and, the type (characteristic) of recording medium and an ambient environment.

DESCRIPTION OF THE EMBODIMENTS

Various exemplary embodiments, features, and aspects of the invention will be described in detail below with reference to the drawings.

Figure 1:
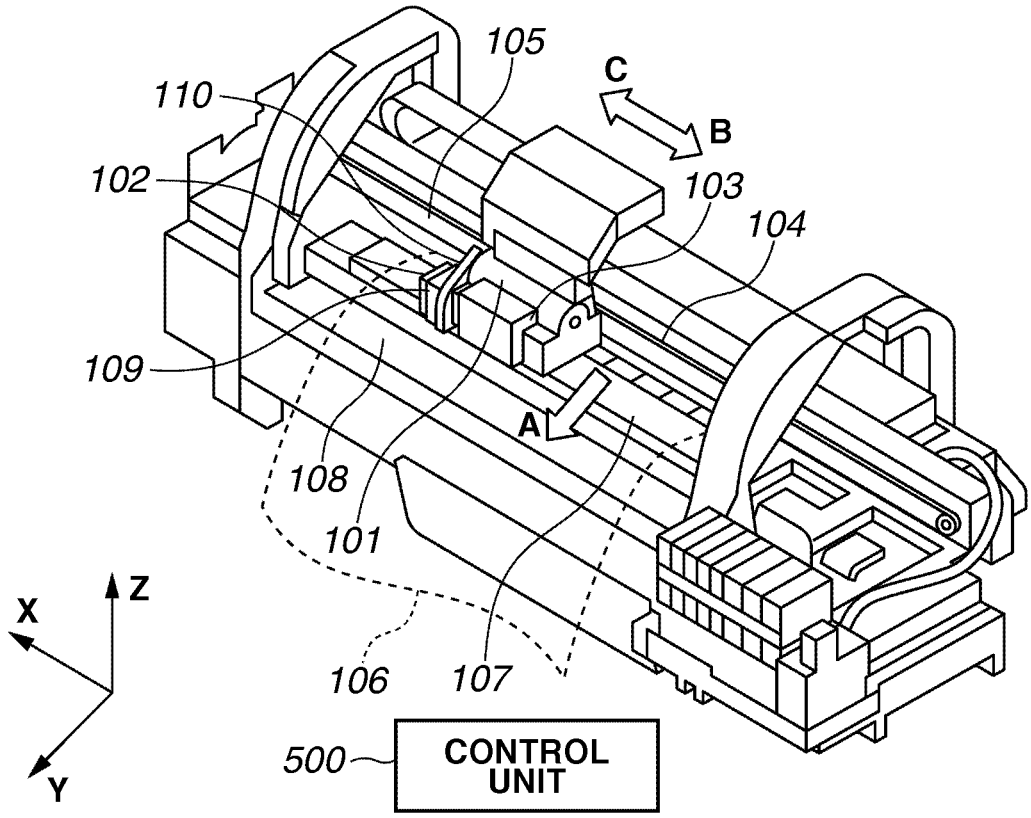
FIG. 1 is a perspective view of an ink jet recording apparatus according to an exemplary embodiment of the present invention.

FIG. 1 is a perspective view of an ink jet recording apparatus according to a first exemplary embodiment of the present invention. The ink jet recording apparatus is configured to record an image by discharging ink from a recording head onto a recording medium based on image information (recording data). The ink jet recording apparatus illustrated in FIG. 1 includes a carriage 101 capable of making a reciprocating motion along a guide shaft 105 disposed at the main body of the recording apparatus. A recording head 103 and a detection unit 102 are mounted on the carriage 101. This detection unit 102 is constituted by a sensor for detecting a distance to a measurement surface defined by, for example, a recording surface of a recording medium. Further, a cutter unit 109, which is a unit for cutting a recording medium, and a cutter protection member 110 for protecting the cutter unit 109 are mounted on the carriage 101.

A platen 107 is disposed at a position opposite to the recording head 103 for supporting a recording medium 106 on which an image is recorded. The recording medium 106 is conveyed on the platen 107 by a not-illustrated conveyance roller. The arrow Y indicates a conveyance direction (sub-scanning direction) of the recording medium 106. Further, the arrow Z indicates a direction perpendicular to an XY plane defied by the X direction and the Y direction. During a recording operation, an image is formed by discharging ink from the recording head 103 onto the recording medium 106 while the carriage 101 is driven to scan in the X direction on the recording medium 106 conveyed onto the platen 107 by the conveyance roller. An image is recorded throughout the entire region of the recording medium 106 by alternately repeating recording of one line with use of the recording head 103 and conveyance of the recording medium 106 with use of the conveyance roller by a predetermined pitch. After image recording is completed, the recording medium 106 is conveyed to a cutting position of the platen 107 on the downstream side in the conveyance direction by the conveyance roller.

Figure 13:
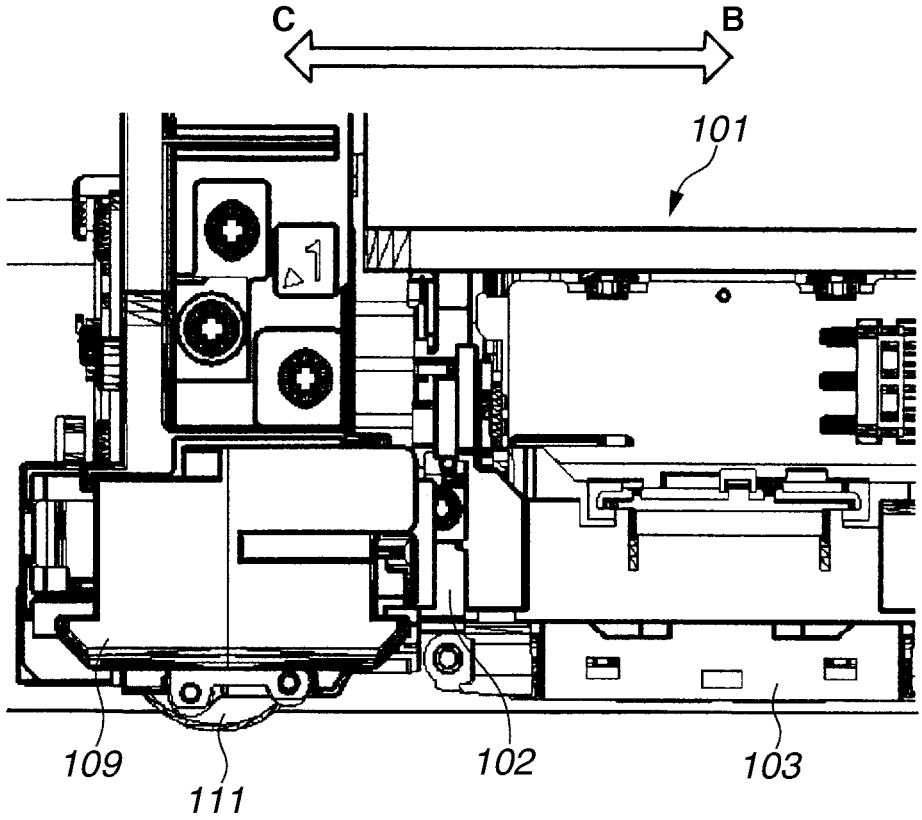
FIG. 13 is a partial front view illustrating the positional relationship among the detection unit, a recording head, and a cutter unit mounted on the carriage in a cutting direction.

For example, as illustrated in FIG. 13, the detection unit 102, the recording head 103, and the cutter unit 109 mounted on the carriage 101 are disposed in a predetermined positional relationship in the cutting direction (the direction intersecting with the conveyance direction). A sheet discharge guide 108 is disposed at a position spaced apart from the platen 107 by a predetermined interval on the downstream side of the platen 107 in the conveyance direction, to guide the recording medium 106 discharged from the main body of the recording apparatus. A cutter groove (not illustrated) is formed between the platen 107 and the sheet discharge guide 108 to guide a movement of the cutter unit 109 in the cutting direction (the arrow B direction). The above-described cutting position is located in a region where the cutter unit 109 moves in the arrow B direction (the direction intersecting with the conveyance direction). When the cutter unit 109 cuts the recording medium 106, first, the carriage 101 is moved in the arrow C direction (preparation direction), and then the cutter unit 109 is moved in the arrow B direction (cutting direction) through a movement of the carriage 101 in the reverse direction with a flat blade (rotary blade) 111 inserted in the cutter groove. As a result, the recording medium 106 is cut by the flat blade 111, and the recorded portion of the recording medium 106, which is located downstream of the cutting position in the conveyance direction, is cut off. On the carriage 101, the detection unit 102 is disposed so that the measurement region of the detection unit 102 is positioned upstream of the face surface (ink discharge surface) of the recording head 103 in the cutting direction, and the bottom surface of the sensor 102 is positioned at the height equal to or higher (i.e., away from the recording medium 106) than the face surface of the recording head 103.

A control unit 500 is disposed at the main body of the recording apparatus. The control unit 500 is constituted by a controller including a central processing unit (CPU), a memory, an input/output (I/O) circuit, and others. This control unit 500 controls operations of a drive motor and other various devices according to a control program stored in an internal memory in advance. Thus, an image is recorded onto the recording medium 106 by controlling recoding operations of the recording medium 106 (including, for example, a sheet feed conveyance operation and a cutting operation), and controlling drive of the recording head 103 based on image data. Further, the control unit 500 controls a detection operation of the detection unit 102, which will be described later, and controls other overall operations of the recording apparatus, and timing therefor as well.

Figure 2A:
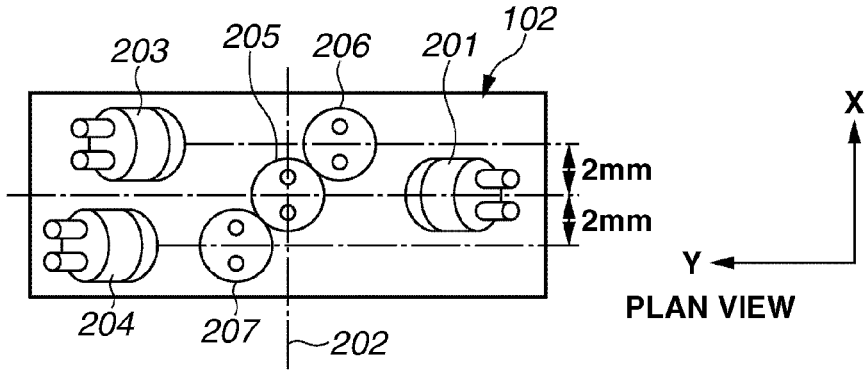
FIGS. 2A and 2B are respectively a plan view and a vertical cross-sectional view of a detection unit mounted on a carriage.
Figure 2B:
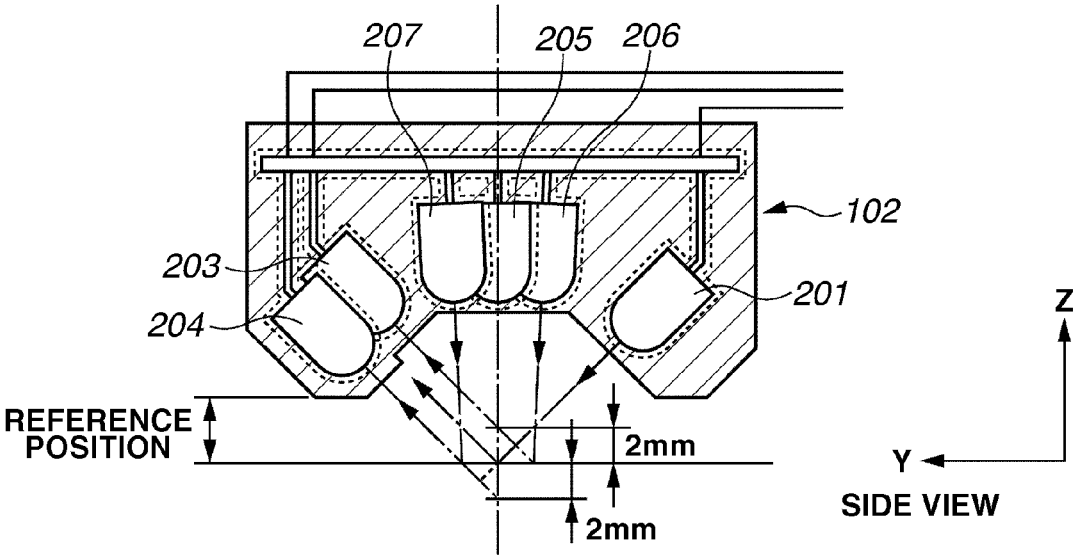

FIGS. 2A and 2B are respectively a plan view and a vertical cross-sectional view of the detection unit 102 mounted on the carriage 101. The detection unit 102 includes two phototransistors 203 and 204, three visible light-emitting diodes (LED) 205, 206, and 207, and one infrared LED 201 as optical elements. These elements are driven by a not-illustrated external circuit. Further, these elements each are embodied by a bullet-shaped element with a maximum diameter of about 4 mm (for example, a commonly available mass-production type with a diameter of 3.0 to 3.1 mm). The infrared LED 201 is disposed so that the infrared LED 201 has an irradiation angle of 45 degrees with respect to the surface (referred to as "measurement surface") of the recording medium 106 that is parallel to the XY plane, and the center (irradiation axis) of light irradiated from the infrared LED 201 intersects with a sensor center axis 202 parallel to a normal (Z axis) of the measurement surface at a predetermined position. The position of this intersection point relative to the detection unit 102 is referred to as "reference position".

The width of light irradiated from the infrared LED 201 is adjusted by an opening thereof to be optimized for formation of an illuminated surface about 4 to 5 mm in diameter on the measurement surface located at the reference position. The two phototransistors 203 and 204 have a light sensitivity in a wavelength range from visible light to infrared light. The phototransistors 203 and 204 are arranged so that optical axes of light beams that the phototransistors 203, 204 receive become parallel to a reflection axis of the infrared LED 201 when the measurement surface is located at the reference position. More specifically, the phototransistor 203 and 204 are arranged so that the light receiving axis of the phototransistor 203 is located at a position deviated +2 mm in the X direction and +2 mm in the Z direction from the reflection axis, and the light receiving axis of the phototransistor 204 is located at a position deviated −2 mm in the X direction and −2 mm in the Z direction from the reflection axis. When the measurement surface is located at the reference position, the intersection point between the optical axis of light irradiated from the infrared LED 201 and the measurement surface coincides with the intersection point between the optical axis of light irradiated from the visible LED 205 and the measurement surface, and the regions of light beams that the two phototransistors 203 and 204 receive are formed so as to sandwich this intersection point. Further, a spacer about 1 mm thick is disposed between the two phototransistors 203 and 204 so as to prevent light beams that the phototransistors 203 and 204 receive from wrapping around each other. Each of the phototransistors 203 and 204 also has an opening to limit a range where incoming light enters. The size of this opening is optimized so that the phototransistors 203 and 204 can receive only light reflected from a range 3 to 4 mm in diameter on the measurement surface at the reference position.

The visible LED 205 is an monochromatic visible LED having a green light emission wavelength (about 510 nm to 530 nm), and is disposed so as to correspond to the sensor center axis 202. The visible LED 206 is a monochromatic visible LED having a blue light emission wavelength (about 460 nm to 480 nm) and, as illustrated in FIG. 2A, is disposed at a position deviated +2 mm in the X direction and −2 mm in the Y direction from the visible LED 205. The LED 206 is disposed so that the irradiation axis of the visible LED 206 intersects with the light receiving axis of the phototransistor 203 at the intersection point between the irradiation axis of the visible LED 206 and the measurement surface, when the measurement surface is located on the reference position. The LED 207 is a monochromatic visible LED having a red light emission wavelength (about 620 nm to 640 nm). This monochromatic visible LEG 207 is disposed at a position deviated (offset) −2 mm in the X direction and +2 mm in the Y direction from the visible LED 205, and is disposed so that the irradiation axis of the LED 207 intersects with the optical light receiving axis of the phototransistor 204 at the intersection point between the irradiation axis of the visible LED 207 and the measurement surface when the measurement surface is located at the reference position.

Figure 3:
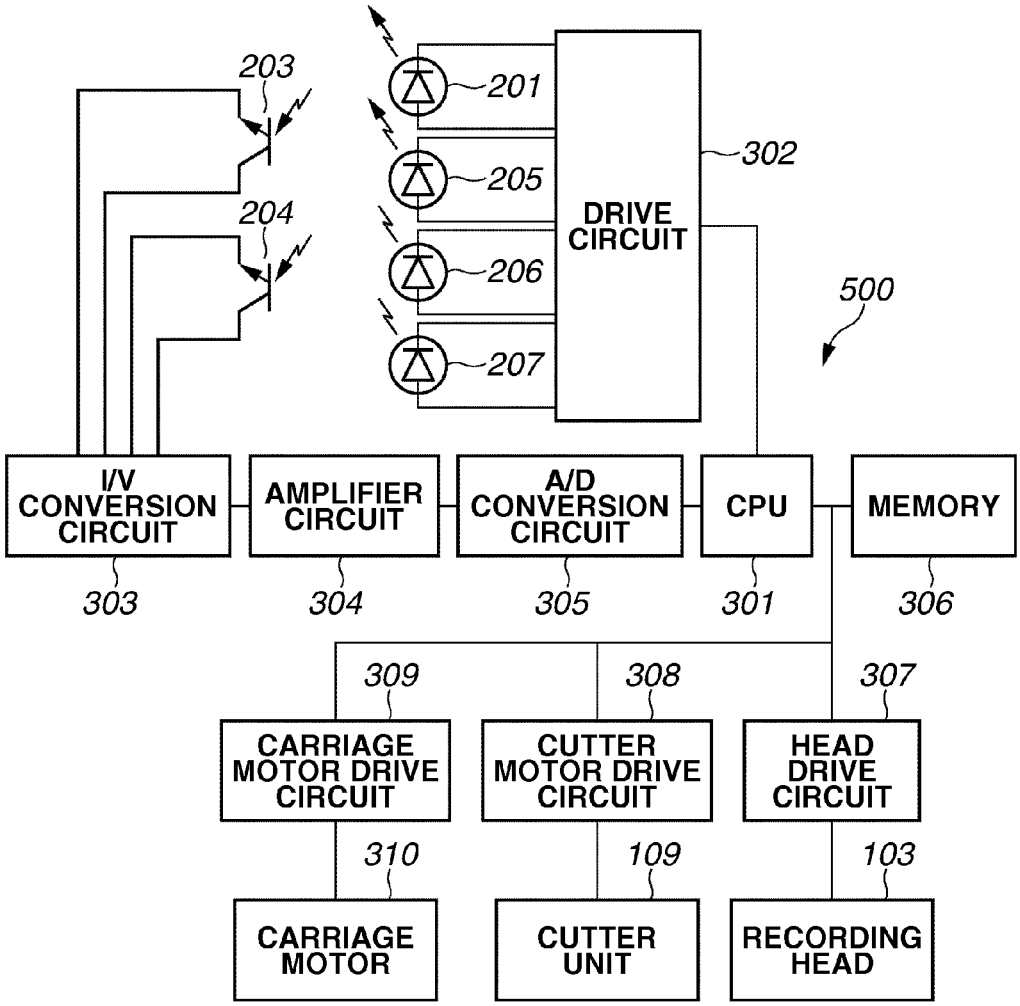
FIG. 3 is a block diagram illustrating a configuration of a controller which processes an input/output signal to/from the detection unit in a control unit of the ink jet recording apparatus.

FIG. 3 is a block diagram of a controller for processing an input/output signal to/from the detection unit 102 in the control unit 500 of the ink jet recording apparatus. A CPU 301 controls, for example, outputs of ON/OFF control signals to the infrared LED 201 and the visible LEDs 205 to 207, and calculations of output signals acquired according to amounts of light received by the phototransistors 203 and 204. A drive circuit 302 functions to supply a constant current to each of the light emitting elements to turn them on, upon reception of an ON signal transmitted from the CPU 301. A current/voltage (I/V) conversion circuit 303 functions to convert output signals transmitted from the phototransistors 203 and 204 as current values into voltage values. An amplifier circuit 304 functions to amplify the output signal after the conversion to the voltage value which is a weak signal to an optimum level for analog/digital (A/D) conversion. An A/D conversion circuit 305 functions to convert the output signal amplified by the amplifier circuit 304 into a 10-bit digital value and input it to the CPU 301. A memory 306 is used for storing a reference table for extracting a desired measurement value based on a calculation result of the CPU 301, and is also used for temporary storage of an output value. The CPU 301 performs overall control of the recording apparatus. A program for enabling the CPU 301 to work, and control tables for, for example, head drive and motor drive, are stored in the memory 306 in advance. A head drive circuit 307 is a drive circuit for driving the recording head 103, and receives recording data transmitted from the CPU 301 to further transfer it to the recording head 103. The cutter unit 109 includes the flat blade (rotary blade) 111, and a cutter motor for moving the flat blade to a position enabling the flat blade to cut the recording medium 106 and a position where the flat blade is retracted from the position enabling the cutting. A cutter motor drive circuit 308 drives the cutter motor. A carriage motor 310 moves the carriage 101 in the direction intersecting with the recording medium conveyance direction. A carriage motor drive circuit 309 drives the carriage motor 310.

Figure 4A:
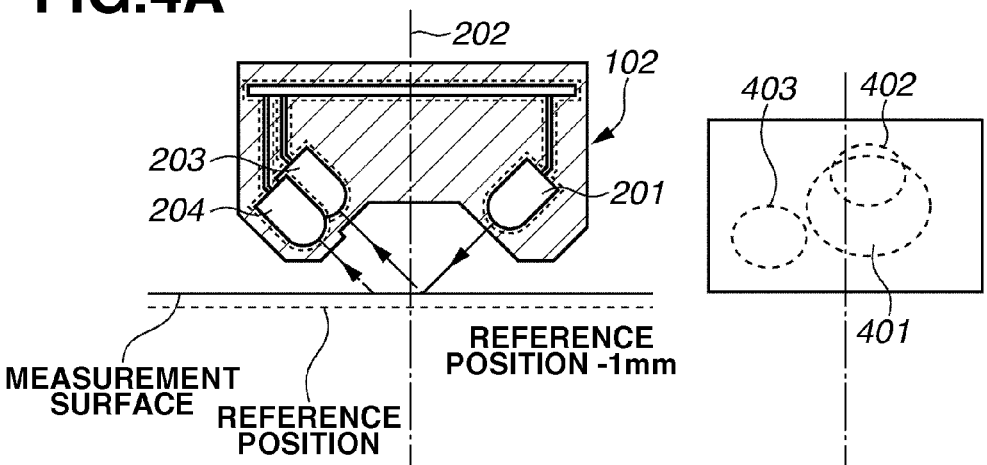
FIGS. 4A, 4B, and 4C illustrates changes in an illuminated region and light receiving regions according to the distance between the detection unit and a measurement surface.
Figure 4B:
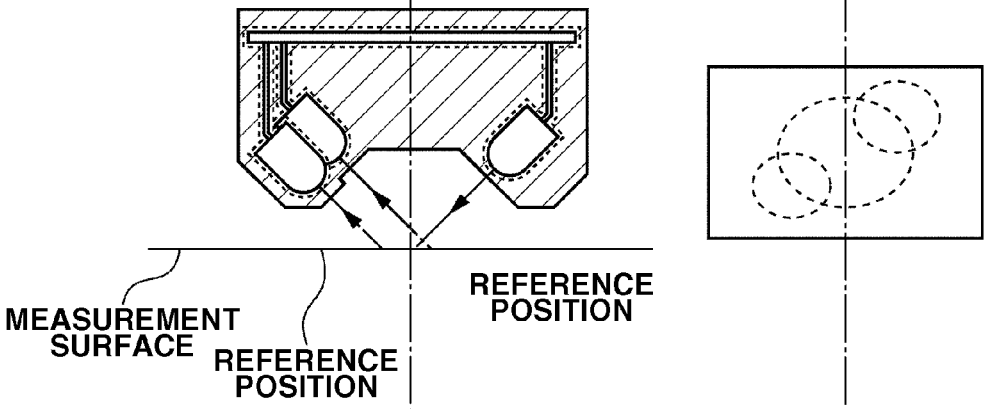
Figure 4C:
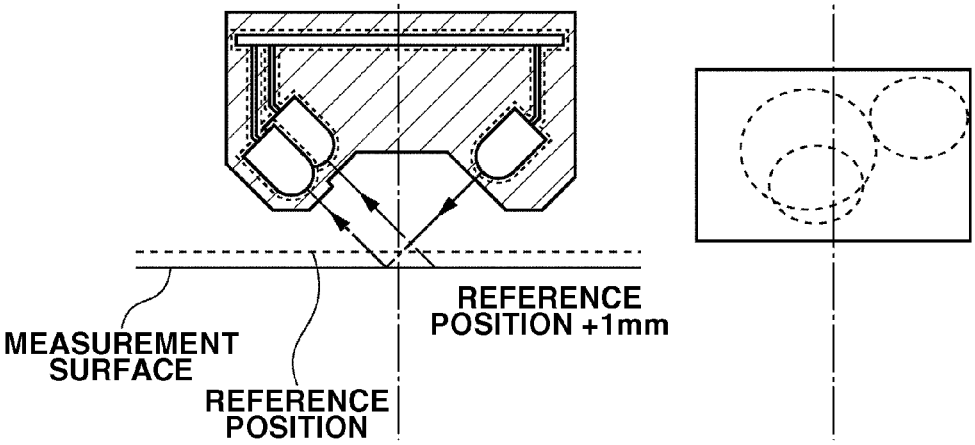
Figure 5:
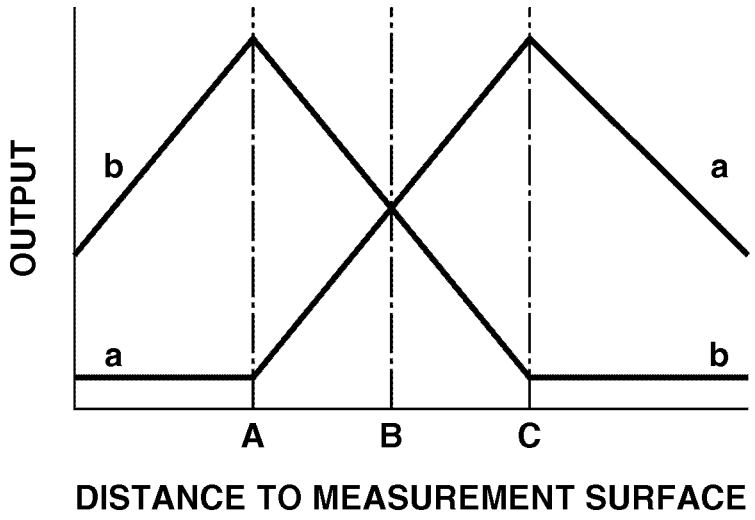
FIG. 5 is a graph indicating output changes with respect to the distance between the detection unit and the measurement surface.
Figure 6:
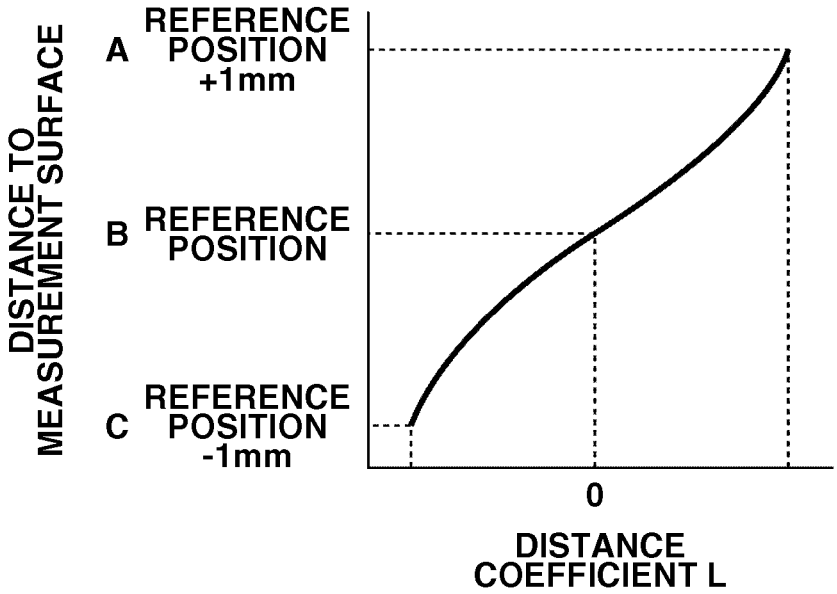
FIG. 6 is a table indicating a distance coefficient with respect to the distance between the detection unit and the measurement surface.

FIGS. 4A, 4B and 4C illustrate changes in the illuminated region and the light receiving regions according to the distance between the detection unit 102 and the measurement surface. More specifically, FIG. 4A illustrates the illuminated region and the light receiving regions when the measurement surface is closer to the detection unit 102 than the reference position is to the detection unit 102. FIG. 4B illustrates the illuminated region and the light receiving regions when the measurement surface is located at the reference position. FIG. 4C illustrates the illuminated region and the light receiving regions when the measurement surface is away from the detection unit 102 more than the reference position is from the detection unit 102. FIG. 5 is a graph illustrating changes in outputs of the phototransistors 203 and 204 according to the distance between the detection unit 102 and the measurement surface. FIG. 6 is a table indicating a distance coefficient with respect to the distance between the detection unit 102 and the measurement surface. The following procedure is taken when the distance to the recording medium 106 is detected with use of the detection unit 102. After the recording medium 106 is conveyed onto the platen 107 by the conveyance roller, the detection unit 102 is moved to a position above the recording medium 106 and the infrared LED 201 is turned on. The light emitted from the infrared LED 201 is reflected by the measurement surface, and the phototransistors 203 and 204 receive a part of the reflected light. The outputs of the phototransistors 203 and 204 vary in relation to the areas where the illuminated region 401 of the infrared LED 201 and the light receiving regions 402 and 403 of the phototransistors 203 and 204 overlap, which varies according to the distance to the measurement surface.

In the above-described positional arrangement of the phototransistors 203 and 204, the centers of the light receiving regions 402 and 403 are measured as points offset from the center of the illuminated region 401. Therefore, the areas where the illuminated region 401 and the light receiving regions 402 and 403 overlap are significantly changed even by a slight change in the distance between the sensor 102 and the measurement surface, compared to the arrangement in which the centers of the regions 402 and 403 are measured as points located on the center (sensor center axis) 202. FIGS. 4A, 4B, and 4C illustrate changes in the positions of the illuminated region 401 and the light receiving regions 402 and 403 which are changed according to the distance between the sensor 102 and the measurement surface. FIG. 5 illustrates changes in the outputs of the two phototransistors 203 and 204 according to the distance between the sensor 102 and the measurement surface. The lines a and b in FIG. 5 represent the outputs of the phototransistors 203 and 204, respectively.

Referring to FIG. 4A, when the distance between the sensor 102 and the measurement surface is about 1 mm shorter than the distance between the sensor 102 and the reference position (when the measurement surface is located at the position of the reference position −1 mm) as illustrated in the left diagram, most of the light receiving region 402 of the phototransistor 203 overlaps with the illuminated region 401 as illustrated in the right diagram, and the output at this time hits a peak as indicated at the position C in FIG. 5. On the other hand, the light receiving region 403 of the phototransistor 204 is deviated from the illuminated region 401, and the output of the phototransistor 204 is minimized at this time.

Referring to FIG. 4B, when the measurement surface is located at the reference position relative to the sensor 102 as illustrated in the left diagram (when the recording surface of the recording medium 106 coincides with the reference position), the area where the light receiving region 402 of the phototransistor 203 and the illuminated region 401 of the infrared LED 201 overlap becomes substantially equal to the area where the light receiving region 403 of the phototransistor 204 and the illuminated region 401 of the infrared LED 201 overlap as illustrated in the right diagram, and the outputs of the phototransistors at this time are dropped to almost halves of their peaks as illustrated at the position B in FIG. 5.

Referring to FIG. 4C, when the distance between the sensor 102 and the measurement surface is about 1 mm longer than the distance between the sensor 102 and the reference position (when the measurement surface is located at the position of the reference position +1 mm) as illustrated in the left diagram, most of the light receiving region 403 of the phototransistor 204 overlaps with the illuminated region 401 as illustrated in the right diagram, and the output of the phototransistor 204 at this time hits a peak as indicated at the position A in FIG. 5. On the other hand, the light receiving region 402 of the phototransistor 203 is deviated from the illuminated region 401, and the output of the phototransistor 203 is minimized at this time.

In this way, the outputs of the two phototransistors 203 and 204 vary according to the distance between the detection unit 102 and the measurement surface. The interval between the positions where the outputs of the two phototransistors 203 and 204 are maximized is determined based on the relative offset amount between the phototransistors 203 and 204 in the Z direction, the inclination degrees of the phototransistors 203 and 204 relative to the measurement surface, and the inclination degree of the infrared LED 201 relative to the measurement surface. This positional arrangement is optimized based on the width of a desired measurement range. Upon acquisition of the outputs of the two phototransistors 203 and 204 varying according to the distance to the recording medium 106, the CPU 301 calculates a distance coefficient L based on the two outputs.

The distance coefficient L indicated in FIG. 6 can be acquired by the following expression (1) in which Va and Vb represent the outputs of the phototransistors 203 and 204, respectively.

$$L=(Va/Vb)\times\alpha \qquad \text{EXPRESSION (1)}$$

where α is a predetermined constant number determined for each apparatus. The distance coefficient L is a coefficient varying according to the distance between the sensor 102 and the measurement surface, and has a smallest value when the output of the phototransistor 203 is maximized (the reference position −1 mm) and a largest value when the output of the phototransistor 204 is maximized (the reference position +1 mm). It is desirable in consideration of the characteristic of the distance coefficient L that the measurement range is within the range of the peaks of the two phototransistors 203 and 204. In the present exemplary embodiment, the measurement range of the detection unit 102 is from the reference position −1 mm to the reference position +1 mm.

After the acquisition of the distance coefficient L by the arithmetic processing of the CPU 301, a distance reference table stored in the memory 306 is read out. FIG. 6 illustrates an example of the distance reference table. The distance coefficient L acquired by the above-described expression (1) shows a slightly curved increase according to the distance under the influence of the output characteristics of the two phototransistors 203 and 204. This distance reference table is prepared to acquire a more accurate distance to a measured object based on the distance coefficient L acquired from the calculation. The distance to the measured object is calculated from the distance coefficient L acquired from the calculation and the above-described distance reference table, and the value thereof is output. The acquisition of the distance to the measurement surface as the recording surface of the recording medium 106 enables a calculation of, for example, the thickness of the recording medium 106 based on the relative distance from the platen 107.

With use of the above-described detection unit 102, it is possible to detect the distance from the detection unit 102 to the measurement surface and a change in the distance. When the measurement surface is the recording surface of the recording medium 106, it is possible to detect the distance from the detection unit 102 to the recording medium 106 and a change in this distance. Further, it is possible to detect the width (the width in the carriage movement direction) and the thickness of the recording medium 106 by detecting the distance to the platen 107 and the recording medium 106 on the platen 107 and a change therein while the carriage 101 is moved. Then, it is possible to detect the state of the posture of the recording medium 106 while being conveyed, such as sheet uplift, by detecting a change in the distance to the recording medium 106 and the change amount. In this way, the detection unit 102 can utilize the distance to the measurement surface for various purposes by detecting a change therein, and can function as a multipurpose sensor.

The detection unit 102 is different from a commonly-used distance measurement sensor in terms of the following points. As described above, it is possible to detect the distance to the measurement surface as the recording surface of the recording medium 106 with use of the detection unit 102. If two light receiving elements and a light emitting element are disposed on a same plane as in a commonly-used distance measurement sensor, the detection is subject to an influence of blurs of the illuminated region and the light receiving regions due to variation in the intensity of light irradiated to a measurement object and a change in the distance as the characteristics of diffusion light. As a result, a problem arises in that the slope of the line until the output peak and the slope of the line after the output peak become asymmetrical in the output curve of each light receiving element, whereby the accuracy of a distance measurement sensor is deteriorated under the influence of a position where the sensitivity is low. On the other hand, according to the detection unit 102 in the present exemplary embodiment, the symmetry between the rising part and the falling part of the output curve is improved, thereby enabling accurate distance detection.

Generally, recording media have different reflection characteristics according to the types thereof. For example, glossy paper and similar paper mostly cause specular reflection, while plain paper and similar paper mostly cause diffuse reflection. Therefore, there is a slight difference in the change in the distance coefficient L according to the distance, depending on the characteristic of a recording medium. To further accurately detect the distance between the sensor and the surface of a recording medium, it is desirable to select a distance reference table according to the type of a recording medium, instead of preparing only one distance reference table as described above. In the present exemplary embodiment, the infrared LED 201 and the phototransistors 203 and 204 are disposed so that the angle therebetween forms a specular reflection angle to enable distance detection even for a clear film and a similar recording medium. However, for a recording medium showing difficulty in detecting the distance thereto by specular reflection, it is possible to employ the method of using the visible LED 205, which irradiates light perpendicularly to the recording medium, to measure diffusely reflected light of the visible LED 205.

Figure 7:
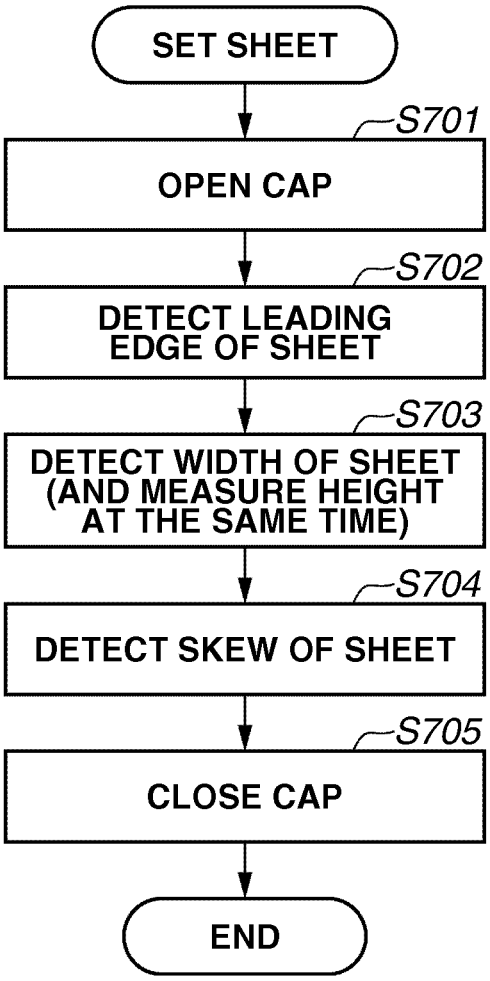
FIG. 7 is a flowchart of an operation when a recording medium is set to the ink jet recording apparatus

FIG. 7 is a flowchart of an operation when the recording medium 106 is set to the recording apparatus. Now, the operation when the recording medium 106 (sheet) is set to the above-described ink jet recording apparatus will be described with reference to FIG. 7. When the sheet is set to the recording apparatus, the control unit 500 carries out three kinds of detection, "detection of the leading edge of the sheet", "detection of the width of the sheet", and "detection of a skew of the sheet", with use of the detection unit 102 which also functions as a multipurpose sensor. First, in step S701, a cap (not illustrated) covering the ink discharge surface of the recording head 103 is opened to enable the carriage 101 to move. Then, the recording medium 106 is conveyed (fed) to a predetermined position in the Y direction by the conveyance roller, and the carriage 101 is moved to a predetermined position in the X direction. After that, in step S702, the leading edge of the recording medium 106 is detected by turning on the visible LED 207 of the detection unit 102, and conveying (back-feeding) the recording medium 106 in the reverse direction until the output of the phototransistor 203 (the line a in FIG. 5) shows a drastic change.

Next, in step S703, the entire region (overall width) of the recording medium 106 is scanned in the arrow C direction illustrated in FIG. 1 by the carriage 101. Again at this time, the control unit 500 uses the detection unit 102, and determines, as the edge of the recording medium 106, the position where the output a of the phototransistor 203 shows a drastic change. The control unit 500 detects two edges, and determines the interval therebetween as "sheet width". When the entire region of the recording medium 106 is scanned, the data "distance from the detection unit 102 to the recording medium 106" throughout the entire sheet width of the recording medium 106 is acquired by also measuring the output b of the phototransistor 204. This distance corresponds to the distance from the sensor 102 to the recording surface (measurement surface) of the recording medium 106. The data "distance from the platen 107 to the recording surface (measurement surface) of the recording medium 106" can be acquired by subtracting "the distance from the detection unit 102 to the recording medium 106" from "the distance from the sensor 120 to the platen 107". This "distance from the platen 107 to the recording surface (measurement surface) of the recording medium 106" is the height of the recording surface of the recording medium 106 relative to the platen 107. Hereinafter, the term "height" is used to refer to "the height of the recording surface of the recording medium 106 relative to the platen 107". Similarly, the term "height" is also used in the description in the flowcharts. Since the positional relationship between the face surface of the recording head 103 and the detection unit 102 should be already known, the distance between the recording head 103 and the recording surface of the recording medium 106 can be calculated from the distance between the detection unit 102 and the recording surface of the recording medium 106.

After the detection of the width of the recording medium 106 and the measurement of the height of the recording medium 106 as described above, in step S704, the edge position of the recording medium 106 is detected again by conveying the recording medium 106 by a predetermined amount in the forward direction or in the reverse direction and acquiring the output "a" of the phototransistor 203. If the edge position detected this time is different from the edge position detected at the time of detection of the sheet width, the control unit 500 determines that "the sheet is skewed", and prompts a user to reset the recording medium 106. After the user resets the recording medium 106 accordingly, the carriage 101 is returned to a predetermined position. Then, in step S705, the cap is closed (the recording head 103 is capped), and the recording apparatus is set into "a standby state", thereby ending the series of operations.

Figure 8:
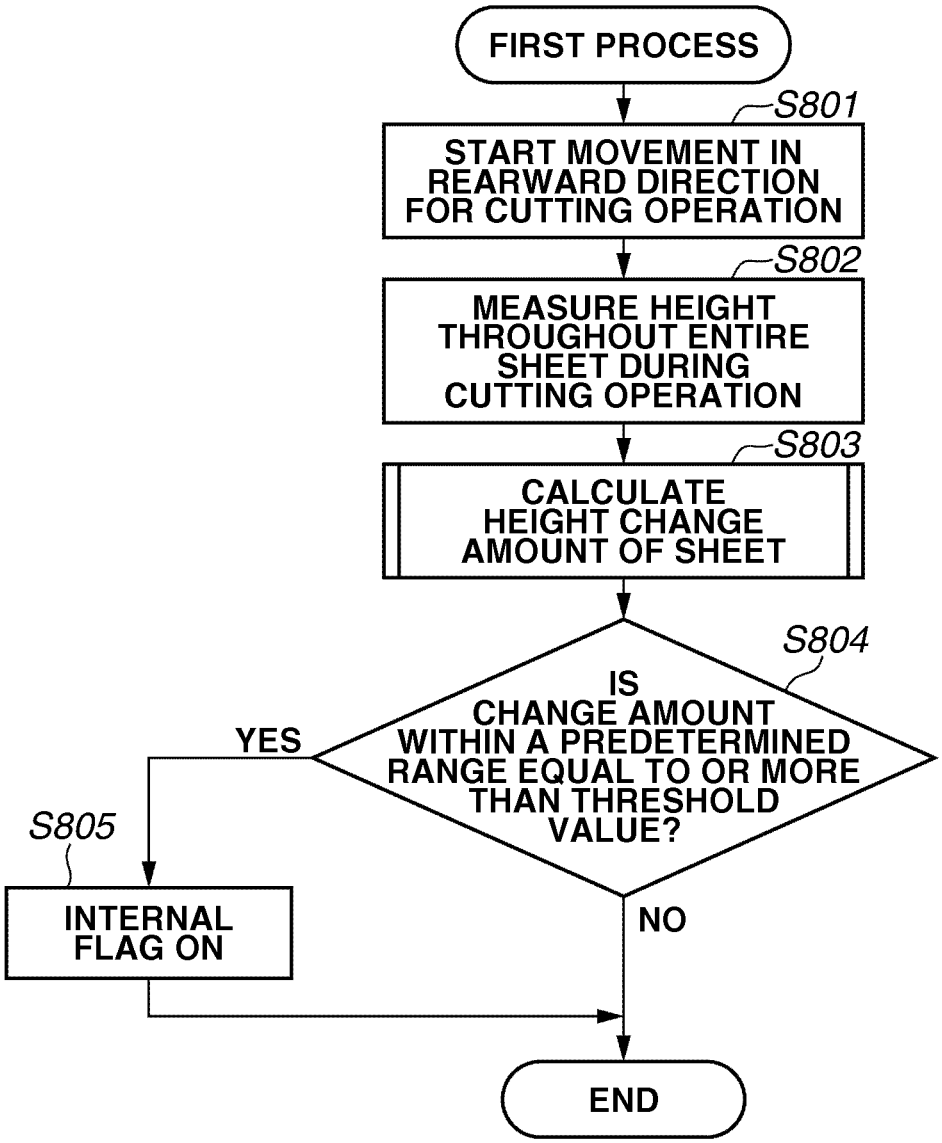
FIG. 8 is a flowchart of a first process for detecting an amount of change in the distance to the recording medium.

FIG. 8 is a flowchart of a first process for detecting the amount of a change in the height to the recording medium 106. The first process is a process of detecting the amount of a change in the distance to the recording medium 106 by the detection unit 102 when the recording medium 106 is cut by the cutter unit 109. This first process utilizes the sequence for cutting the recording medium 106 by the cutter unit 109, which has been already performed, without requiring an additional operation. In step S801, the carriage 101 starts moving in the arrow B direction (the cutting direction and the rearward direction) illustrated in FIG. 1 to cut the recording medium 106. Then, in step S802, the height data throughout the entire sheet width of the recording medium 106 is measured by the detection unit 102 while the cutter unit 109 is cutting the recording medium 106.

Figure 10A:
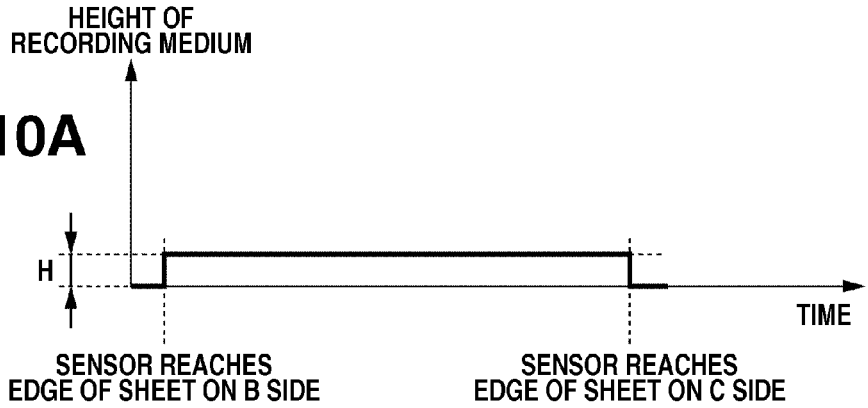
FIGS. 10A, 10B, and 10C illustrates examples of height data detected by the detection unit.
Figure 10B:
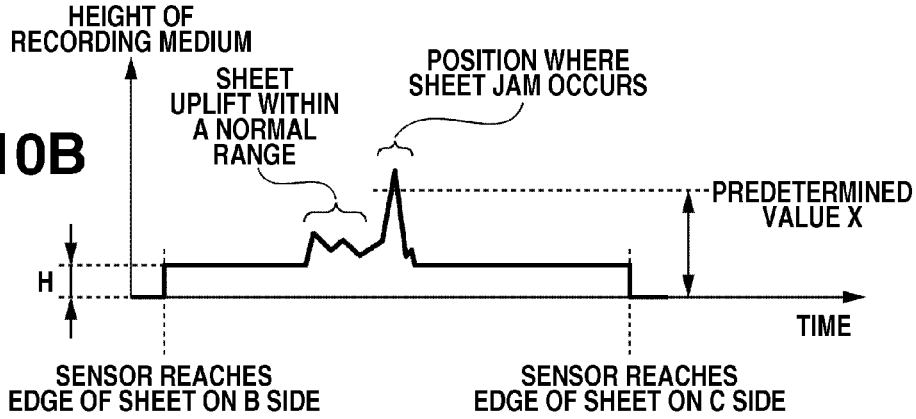
Figure 10C:
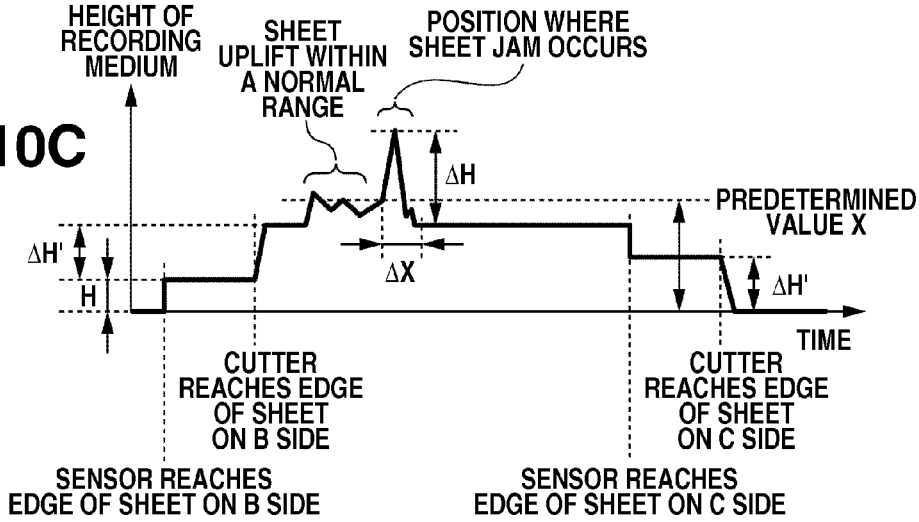

Next, in step S803, the control unit 500 performs a calculation of "a height change amount" of the recording medium 106. FIGS. 10A, 10B, and 10C illustrate the height data detected by the detection unit 102. Now, the procedure of the calculation of "a height change amount" of the recording medium 106 will be described with reference to FIGS. 10A, 10B, and 10C. FIG. 10A indicates that the measurement in step S802 reveals no occurrence of sheet uplift of the recording medium 106, and no change in the detected height of the recording medium 106. In this case, assuming that H represents the thickness of the recording medium 106, the height detected by the detection unit 102 is increased by "H" when the detection unit 102 reaches the edge of the region where the recording medium 106 does not exist on the arrow B side (the arrow B direction) of the recording medium 106. Further, the height detected by the detection unit 102 is reduced by "H", which corresponds to the thickness of the recording medium 106, when the detection unit 102 reaches the edge of the recording medium 106 on the arrow C side (the arrow C direction).

FIG. 10B indicates that the recording medium 106 is in a sheet uplift (also referred to as "sheet jam") state significant enough to cause damage to the recording head 103. In this case, the recording medium 106 has a high height at the position where a sheet jam occurs. Assuming that "X" is a predetermined value for determining "abnormality", the height in the detection data indicated in FIG. 10B exceeds this predetermined value. In the present exemplary embodiment, the measurement operation is carried out while the cutter unit 109 is cutting the recording medium 106. Therefore, the posture of the carriage 101 may be changed depending on how hard cutting of the recording medium 106 is, at the moment that the flat blade (rotary blade) 111 of the cutter unit 109 reaches the edge of the recording medium 106 and starts cutting the recording medium 106. The change in the posture of the carriage 101 causes variation in the distance from the detection unit 102 to the recording medium 106. This change in the posture of the carriage 101 may occur even if the recording medium 106 can be cut in a normal manner without causing any problem. Therefore, the height detected by the detection unit 102 may exceed the predetermined value X even in a normal state.

FIG. 10C indicates variation in the height detected by the detection unit 102 when a change in the posture of the carriage 101 occurs. Assuming that ΔH' represents a height change due to the change in the posture of the carriage 101, the detection unit 102 detects the height "ΔH'+H" when the cutter reaches the sheet edge of the recording medium 106 on the arrow B side (the arrow B direction). Depending on the amount of the height "ΔH'", even if sheet uplift is within a normal range, the height of the recording medium 106 may exceed the predetermined value X. Therefore, in the first process in the present exemplary embodiment, whether the conveyance is normal or abnormal is determined based on "a height change amount", instead of exceedance over the predetermined value X. "The height change amount" here means a height change amount ΔH within each predetermined interval ΔX. According to this procedure, the control unit 500 performs the calculation of "the height change amount" of the recording medium 106 in step S803 of FIG. 8.

Next, in step S804, it is determined whether the change amount ΔH within the predetermined range (for each predetermined interval ΔX) exceeds a threshold value. It should be noted that the determination in step S804 does not immediately lead to error processing, and only turns an internal flag on. If the change amount ΔH calculated in step S803 does not exceed the threshold value (NO in step S804), the first process is ended while the internal flag remains off. On the other hand, if it is determined in step S804 that the change amount ΔH calculated in step S803 exceeds the threshold value (YES in step S804), the process proceeds to step S805 in which the internal flag is turned on, and then the first process is ended. In particular, in the state illustrated in FIG. 10C, if the change amount ΔH within the predetermined interval ΔX is equal to or more than the threshold value in the vicinity of the position where a sheet jam occurs, the internal flag is turned on.

In the above-described first process, the conditions are determined in consideration of "cutting of a sheet". For example, if the recording apparatus employs a suction-type platen configured to attract the recording medium 106 with use of a negative pressure suction force, the suction amount of the platen 107 is maximized under any ambient environment or for any type of recording medium so as to facilitate cutting of the recording medium. This is because the recording medium may be in different states with respect to sheet uplift due to different conditions during a cutting operation and during a recording operation, and the influence of this difference should be reduced. Another reason is because after the recording medium 106 is cut, the conveyance operation of the recording medium 106 may cause alleviation of a sheet uplift state, and simply easing the threshold value for determining "abnormality" in this case may result in overlooking sheet uplift that should be detected, and such overlooking should be avoided. Therefore, in the present exemplary embodiment, the recording apparatus is configured so that "abnormality" is not determined immediately even when a drastic change is detected in the height data in the first process, and a second process is subsequently performed to detect the distance to the recording medium 106 by selecting detection conditions according to a recording operation. As a result, it is possible to improve the accuracy of detecting an abnormal state.

Figure 9:
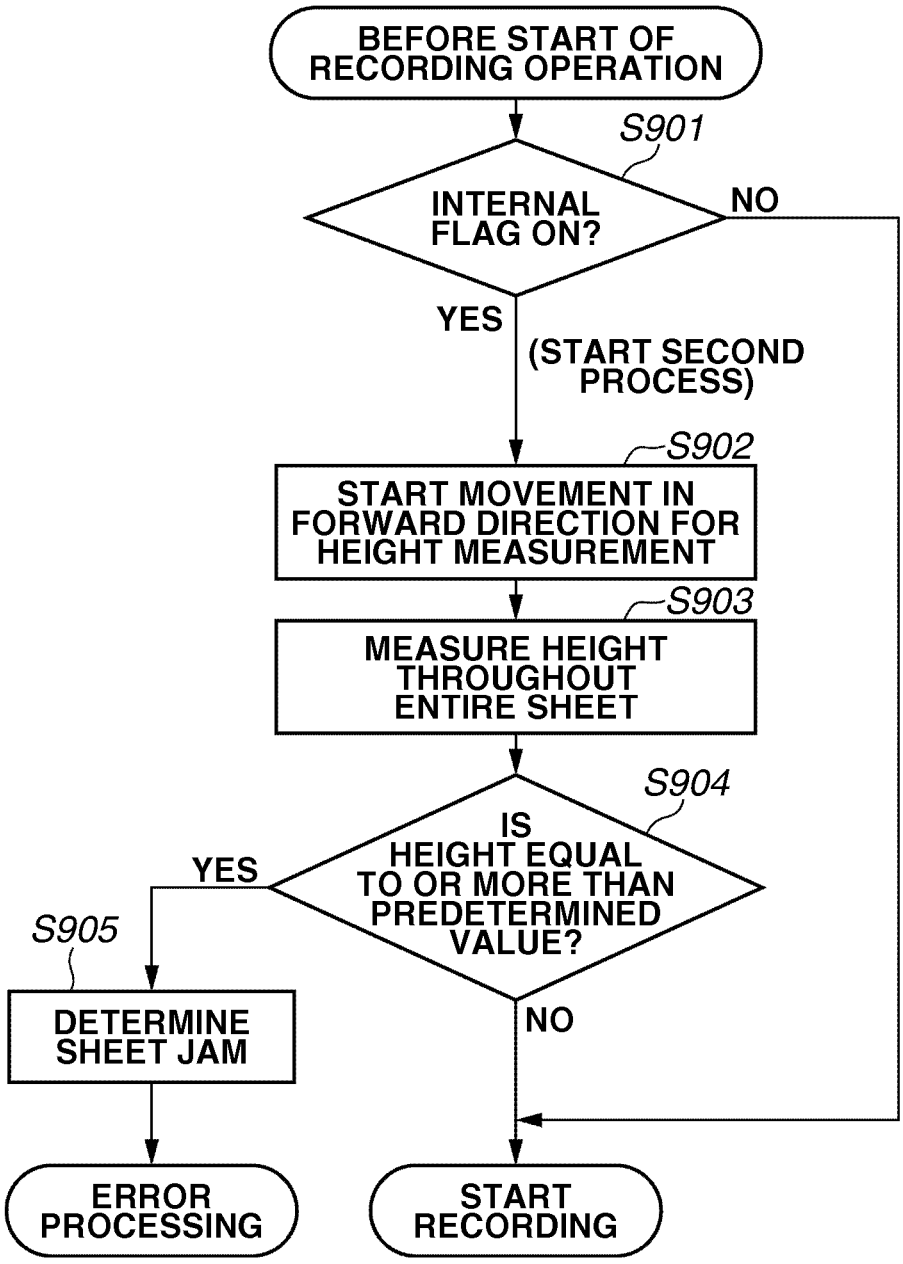
FIG. 9 is a flowchart of a second process for detecting the distance to the recording medium.

FIG. 9 is a flowchart of the second process for detecting the distance to the recording medium 106. After the execution of the above-described first process, the second process is performed to detect the distance to the recording medium 106 with use of the detection unit 102 before a start of a recording operation with use of the recording head 103. Referring to FIG. 9, before a start of a recording operation, in step S901, the control unit 500 checks the state of the internal flag that may be set in step S805 in the first process. If the internal flag remains off (NO in step S901), the control unit 500 determines that no sheet uplift occurs in the first process, and then moves on to a recording operation. On the other hand, if the internal flag is turned on (YES in step S901), the control unit 500 starts the second process, and starts to drive the carriage 101 to move in the arrow C direction (forward direction) in step S902. This second process is carried out after the execution of the above-described first process (FIG. 8), if the detection unit 102 detects in the first process that the amount of change in the distance to the recording medium 106 is equal to or more than the predetermined value. In the second process, the carriage 101 is moved with the cutter unit 109 stowed (non-cutting state in which the cutting blade is retracted), and the detection unit 102 detects the distance to the recording medium 106 throughout the entire region of the recording medium 106.

In other words, the second process is a process for measuring the distance to the recording medium 106 throughout the entire region of the recording medium 106 under the same conditions as a recording operation (without using the cutter unit 109), if the detection unit 102 detects that an amount of change in the distance to the recording medium 106 is equal to or more than the predetermined value in the first process. For example, if the platen 107 is embodied by a suction-type platen configured to attract the recording medium 106 onto the conveyance surface with use of a suction force by, for example, a negative pressure or electrostatic adsorption, this suction force (suction amount) is set according to the type (characteristic) of the recording medium 106 or the ambient environment (temperature and humidity), similarly to the setting during a recording operation. Further, the cutter unit 109 is set into the non-cutting state in which the cutting blade of the cutter unit 109 is retracted as described above so as not to cause a change in the posture of the carriage at the time of the start of a recording operation. In this way, in step S903, while the carriage 101 is moved in the arrow C direction, the control unit 500 acquires the height data throughout the entire region of the recording medium 106 in the width direction, with use of the detection unit 102.

Next, in step S904, it is determined whether the height data acquired in step S903 is equal to or more than a predetermined value. The height of the recording medium 106 is equal to or more than the predetermined value, when the distance from the detection unit 102 to the recording medium 106 is equal to or less than a predetermined distance, or in other words, when the distance between the recording medium 106 and the recording head 103 is equal to or less than a threshold value that may cause damage to the recording head 103. If the height data is equal to or more than the predetermined value (YES in step S904), the process proceeds to step S905 in which it is determined that the recording medium 106 is in an "abnormal" state, where sheet uplift is significant enough to possibly cause damage to the recording head 103. Then, error processing is performed. At this time, since no change occurs in the posture of the carriage 101 due to the operation of the cutter unit 109, whether the state is "abnormal" is determined based on the predetermined value X illustrated in FIGS. 10A, 10B, and 10C. In other word, as illustrated in FIG. 10B, it is determined that the state is "abnormal" if the detected height is equal to or more than the predetermined value X. In this way, false detection can be prevented by making final determination about "abnormality" in the second process based on the result of the first process. On the other hand, if it is determined in step S904 that the height data detected in step S903 is less than the predetermined value X (NO in step S904), then the control unit 500 determines a normal state, and moves onto a recording operation.

The ink jet recording apparatus of the above-described exemplary embodiment includes the recording head 103 configured to discharge ink onto the recording medium 106, the carriage 101 carrying the recording head 103 mounted thereon and configured to make a reciprocating motion, and the cutter unit 109 mounted on the carriage 101 and configured to cut the recording medium 106. The ink jet recording apparatus further includes the detection unit 102 mounted on the carriage 101 and configured to detect the distance to the recording medium 106, and the control unit 500 for controlling an operation of the recording apparatus. The ink jet recording apparatus configured in this way determines whether the recording medium 106 is in an abnormal state by performing the following first and second processes. In the first process, the detection unit 102 detects the change amount ΔH of the distance to the recording medium 106 when the cutter unit 109 cuts the recording medium 106. In the second process, the detection unit 102 detects the distance to the recording medium 106 with the cutter unit 109 retracted if the detection unit 102 detects a change amount equal to or more than the predetermined value in the first process. Then, the control unit 500 determines that the recording medium 106 is in an abnormal state if the distance from the recording head 103 to the recording medium 106 that is detected in the second process is equal to or less than the predetermined value, while the control unit 500 determines that the recording medium is not in an abnormal state if the distance from the recording head 103 to the recording medium 106 that is detected in the second process is more than the predetermined value. Then, if the control unit 500 determines that the recording medium 106 is not in an abnormal state, a recording operation is started with use of the recording head 103.

According to the above-described exemplary embodiment, it is possible to avoid unnecessary execution of the operation for determining an abnormal state when obvious sheet uplift does not occur, due to the execution of the first process at the time of cutting the recording medium 106. Further, it is possible to distinguish a phenomenon peculiarly occurring during a cutting operation from a phenomenon occurring during a recording operation, due to the execution of the second process under same conditions as an actual recording operation without immediately determining an abnormality even when a large change is detected in the first process. As a result, it is possible to improve the accuracy of detecting an abnormal state of the recording medium 106. Therefore, it becomes possible to prevent a recording failure that might otherwise be caused due to an abnormal state, by accurately detecting whether a conveyance state of the recording medium 106 is abnormal without reducing throughput of a recording operation, by an easy method.

Figure 11:
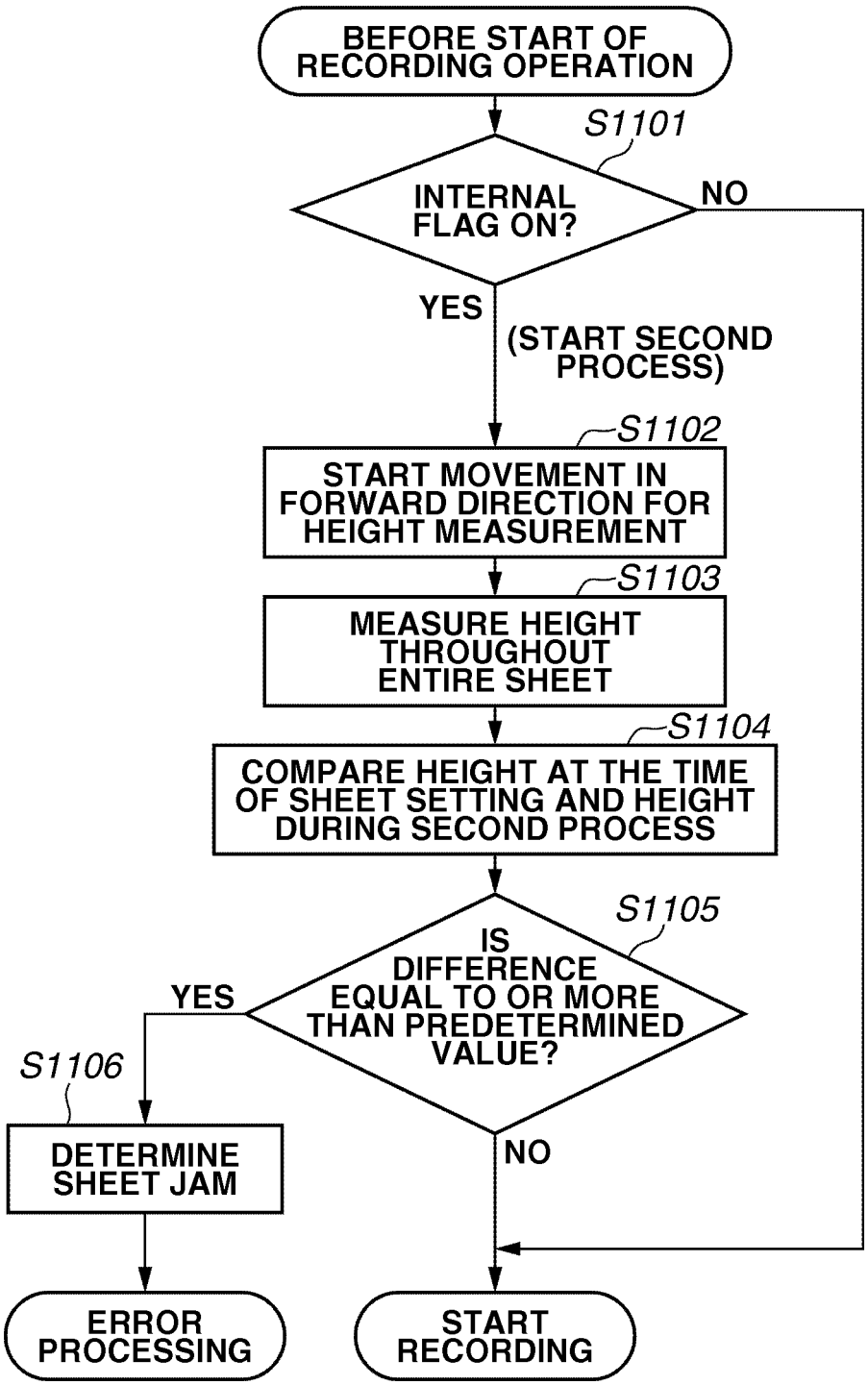
FIG. 11 is a flowchart of another exemplary embodiment of the second process for detecting the distance to the recording medium.

FIG. 11 is a flowchart of another exemplary embodiment of the second process for detecting the distance to the recording medium 106. In the present second exemplary embodiment, the second process in the first exemplary embodiment is replaced with a second process illustrated in FIG. 11, in which the detection unit 102 measures the width of the recording medium 106 by utilizing the difference corresponding to the thickness of the recording medium 106. Then, the control unit 500 acquires the difference between the distance to the recording medium 106 at a plurality of positions of the recording medium 106 in the width direction, and the distance to the recording medium 106 at the plurality of positions that is detected in the second process, and then the control unit 500 determines that the recording medium 106 is in an abnormal state significant enough to lead to, for example, occurrence of a sheet jam or the deterioration of the recorded image quality if the acquired difference is equal to or more than a predetermined value. Other than that, the configuration of the present exemplary embodiment is similar to the first exemplarily embodiment.

The second process in the present exemplary embodiment will be described with reference to FIG. 11. Before a start of a recording operation, in step 1101, the control unit 500 checks the state of the internal flag that may be set in step S805 in the first process in the first exemplary embodiment. If the internal flag remains off (NO in step S1101), the control unit 500 determines that no sheet uplift occurs in the first process, and then moves onto a recording operation. On the other hand, if the internal flag is turned on (YES in step S1101), the control unit 500 starts the second process, and starts to drive the carriage 101 to move in the arrow C direction (forward direction) in step S1102. Then, in step S1103, the control unit 500 acquires the height data throughout the entire region of the recording medium 106 in the width direction with use of the detection unit 102 while causing the carriage 101 to move (scan) in the forward direction.

Next, in step S1104, the control unit 500 compares the height data acquired in step S1103 with the height data detected at the time of measurement of the sheet width in step S703 of FIG. 7, and acquires (calculates) the difference therebetween. Then, in step S1105, it is determined whether the difference calculated in step S1104 is equal to or more than a predetermined value X. If the difference is equal to or more than the predetermined value (YES in step S1105), the process proceeds to step S1106 in which it is determined that the recording medium 106 is in a sheet uplift (i.e., "sheet jam") state significant enough to cause damage to the recording head 103, and then the error processing is performed. On the other hand, if the difference calculated in step S1104 is less than the predetermined value X (NO in step S1105), it is determined that the recording medium 106 is in a normal state, and then a recording operation is started. The present exemplary embodiment is different from the first exemplary embodiment in terms of the above-described features, but other than that, the present exemplary embodiment is structurally similar to the first exemplary embodiment.

According to the present exemplary embodiment, it is possible to cancel factors peculiar to the apparatus such as warpage of the guide shaft 105 and unevenness of the surface of the plate 107, by acquiring the data of the distance to the recording medium 106 at the time of measurement of the width of the recording medium 106, and comparing it with the data acquired in the second process. As a result, it is possible to improve the accuracy of detecting an abnormal state of the recording medium 106. Therefore, it becomes possible to more efficiently prevent a recording failure that might otherwise be caused due to an abnormal state, by accurately detecting whether the conveyance state of the recording medium 106 is abnormal without reducing throughput of a recording operation, by an easy method.

A third exemplary embodiment employs, as the platen 107, a suction-type platen capable of attracting the recording medium 106 onto the conveyance surface with use of a suction force by a negative pressure or electrostatic adsorption so that the recording medium 106 does not float from the conveyance surface. In other words, in the present exemplary embodiment, the platen supporting the recording medium 106 at a position opposing the recording head 103 in the first exemplary embodiment is replaced with a platen capable of attracting the recording medium 106 by a suction force. Then, the suction force of the platen in the second process is controlled so as to be changed according to the type (characteristic) of recording medium or an ambient environment (temperature and humidity), as in the setting during a recording operation. For example, if the recording medium 106 has low rigidity, a strong suction force may make the unevenness of the surface of the recording medium 106 noticeable and influence the recorded image quality. Therefore, in this case, a small value is set to the suction force. On the contrary, if the recording medium 106 has high rigidity, a large value is set to the suction force so as to prevent sheet uplift. In addition, since a change in an ambient environment causes a change in the state of the recording medium 106, the suction force is also changed according to an ambient environment, if necessary. The present exemplary embodiment is different from the first exemplary embodiment in terms of the above-described features, but other than that, the present exemplary embodiment is structurally similar to the first exemplary embodiment.

FIG. 12 is a table indicating an example of the relationship between, the type of recording medium and the ambient environment (temperature), and the suction force of the platen 107. The numerical values listed in the table of FIG. 12 indicate the percentage (%) relative to the maximum suction force. For example, "100" indicates the maximum suction force in full, and "90" indicates that a suction force is 90% of the maximum suction force. In the table of FIG. 12, the suction amount for each ambient environment varies depending on the type of recording medium. Further, the suction force may be changed in consideration of "humidity", in addition to the temperature. However, when the cutter unit 109 is cutting a recording medium, the suction force of the platen 107 is maximized to prioritize the cutting function. As a result, the suction force during a cutting operation may be different from the suction force during a recording operation, and a sheet uplift state may be different from each other. Therefore, in the second process, the recording medium is attracted to the platen 107 by a suction force similar to the setting during a recording operation, at the time of detection of the distance to the recording medium.

According to the present exemplary embodiment, it is possible to perform the detection operation under a same suction force as the setting during a recording operation in the second process, even when the suction force of the platen 107 during a recording operation is different from the suction force during a cutting operation, whereby the state of sheet uplift is different from each other. As a result, it is possible to improve the accuracy of detecting an abnormal state of the recording medium 106. Therefore, it becomes possible to more efficiently prevent a recording failure that might otherwise be caused due to an abnormal state, by accurately detecting whether the conveyance state of the recording medium 106 is abnormal without reducing throughput of a recording operation, by an easy method.

In a fourth exemplary embodiment, the positional relationship among the detection unit 102, the recording head 103, and the cutter unit 109 mounted on the carriage 101 in the above-described first exemplary embodiment is replaced with the positional relationship in which the detection unit 102 is disposed between the cutter unit 109 and the recording head 103 in the movement direction of the carriage 101. As illustrated in FIG. 13, on the carriage 101, the recording head 103, the detection unit 102, and the cutter unit 109 (rotary blade 111) are disposed in this order from the upstream side to the downstream side in the arrow C direction (the preparation direction which is a reverse direction of the cutting direction B). This positional relationship also means that, as viewed from the cutting direction indicated by the arrow B, the detection unit 102 is disposed upstream of the recording head 103, and the cutter unit 109 is disposed upstream of the detection unit 102. According to this positional relationship, if sheet uplift occurs when the cutter unit 109 is cutting the recording medium 106, the detection unit 102 can detect the sheet uplift before the recording head 103 reaches the sheet uplift. The present exemplary embodiment is different from the first exemplary embodiment in terms of the above-described features, but other than that, the present exemplary embodiment is structurally similar to the first exemplary embodiment.

According to the present exemplary embodiment, it is possible to detect a sheet uplift state generated during a cutting operation before the recording head 103 reaches the sheet uplift state, due to the presence of the detector (detection unit 102) between the cutter (cutting unit 109) and the recording head 103 in the main scanning direction. As a result, it is possible to ensure detection of a sheet uplift state causing the recording head 103 to be scratched. Therefore, it becomes possible to more efficiently prevent a recording failure that might otherwise be caused due to an abnormal state, by accurately detecting whether the conveyance state of the recording medium 106 is abnormal without reducing throughput of a recording operation with use of an easy method.

A fifth exemplary embodiment is configured so that, when the detection unit 102 detects the change amount of the distance to the recording medium 106 while the cutter unit 109 is cutting the recording medium 106, the detection result within a predetermined range from a start of cutting by the cutter unit 109 is not used for the determination whether the recording medium 106 is in an abnormal state. In other words, the present exemplary embodiment is different from the first exemplary embodiment in terms of detection of the change amount of the distance to the recording medium 106 in the first process; the present exemplary embodiment is configured so that, in the first process, the detection result within the predetermined range from a start of cutting is excluded from the determination whether the recording medium 106 is in an abnormal state. The present exemplary embodiment is similar to the first exemplary embodiment, except for the above-described features.

For example, it may be hard to cut a recording medium by the cutter unit 109 depending on the type (characteristic) of the recording medium and the ambient environment. In such a case, the cutter unit 109 may be "caught" and thereby the posture of the carriage 101 may be tilted, when the cutter unit 109 starts cutting after reaching the edge of the recording medium 106 in the width direction. The tilt of the carriage 101 may cause the distance detected by the detection unit 102 to change even when the recording medium 106 is in a normal state, thereby making accurate distance detection impossible. The present exemplary embodiment considers the possibility of such an inconvenient situation, and is configured such that sheet uplift is not determined within the predetermined range from a start of cutting by the cutter unit 109.

Figure 14:
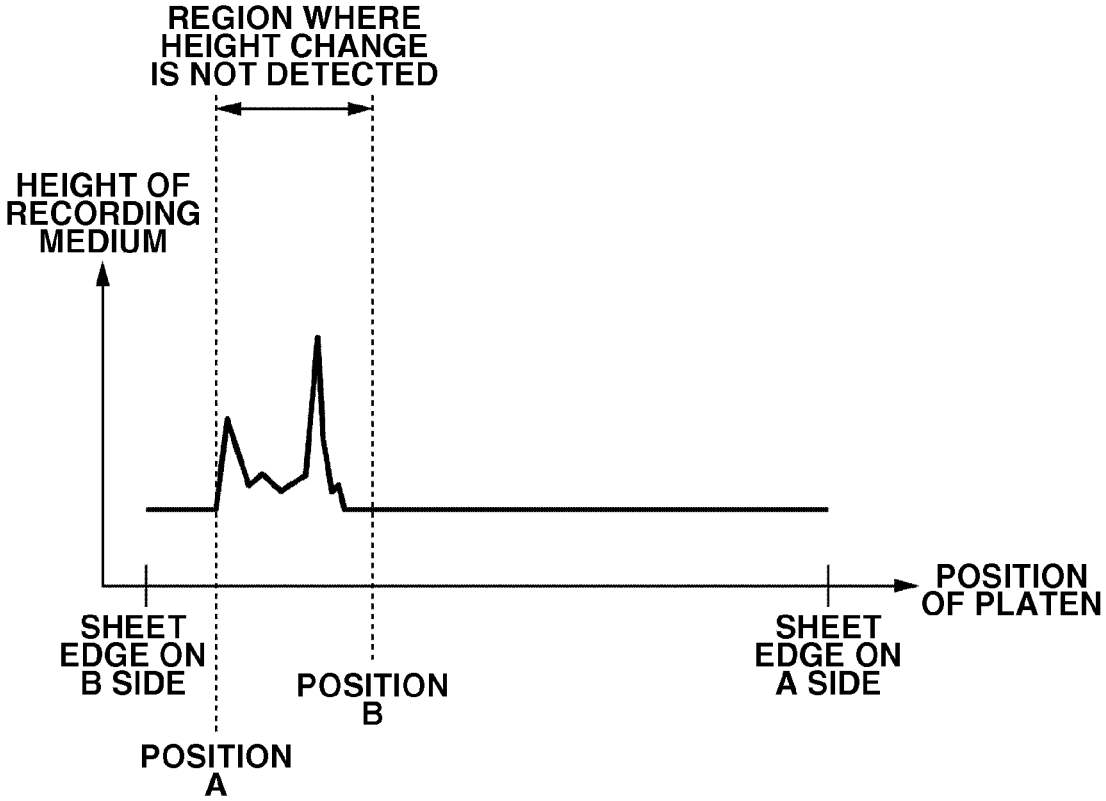
FIG. 14 is a graph indicating a detection example of height data when presence or absence of an abnormality in the recording medium is not determined within a predetermined range.

FIG. 14 is a graph illustrating an example of height data detected by the detection unit 102 according to the present exemplary embodiment in which sheet uplift is not determined within the predetermined range after a start of cutting. In the example illustrated in FIG. 14, the range from a position A to a position B on the platen 107 is set as a non-detected region where a height change is not detected. The control unit 500 controls the detection so that, even if the height exceeds a predetermined value in the region from the position A to the position B, this exceedance is not used for determination of normality/abnormality.

The present exemplary embodiment is configured such that the vicinity of the cutting start position is excluded from the detection, since a start of cutting may cause the posture of the carriage 101 and therefore the output of the detection unit 102 to change depending on the characteristic of recording medium. As a result, it is possible to prevent false detection of "abnormality" when the recording medium 106 is actually in a normal state. Therefore, it becomes possible to more efficiently prevent a recording failure that might otherwise be caused due to an abnormal state, by accurately detecting whether the conveyance state of the recording medium 106 is abnormal without reducing throughput of a recording operation, by an easy method.

Figure 15:
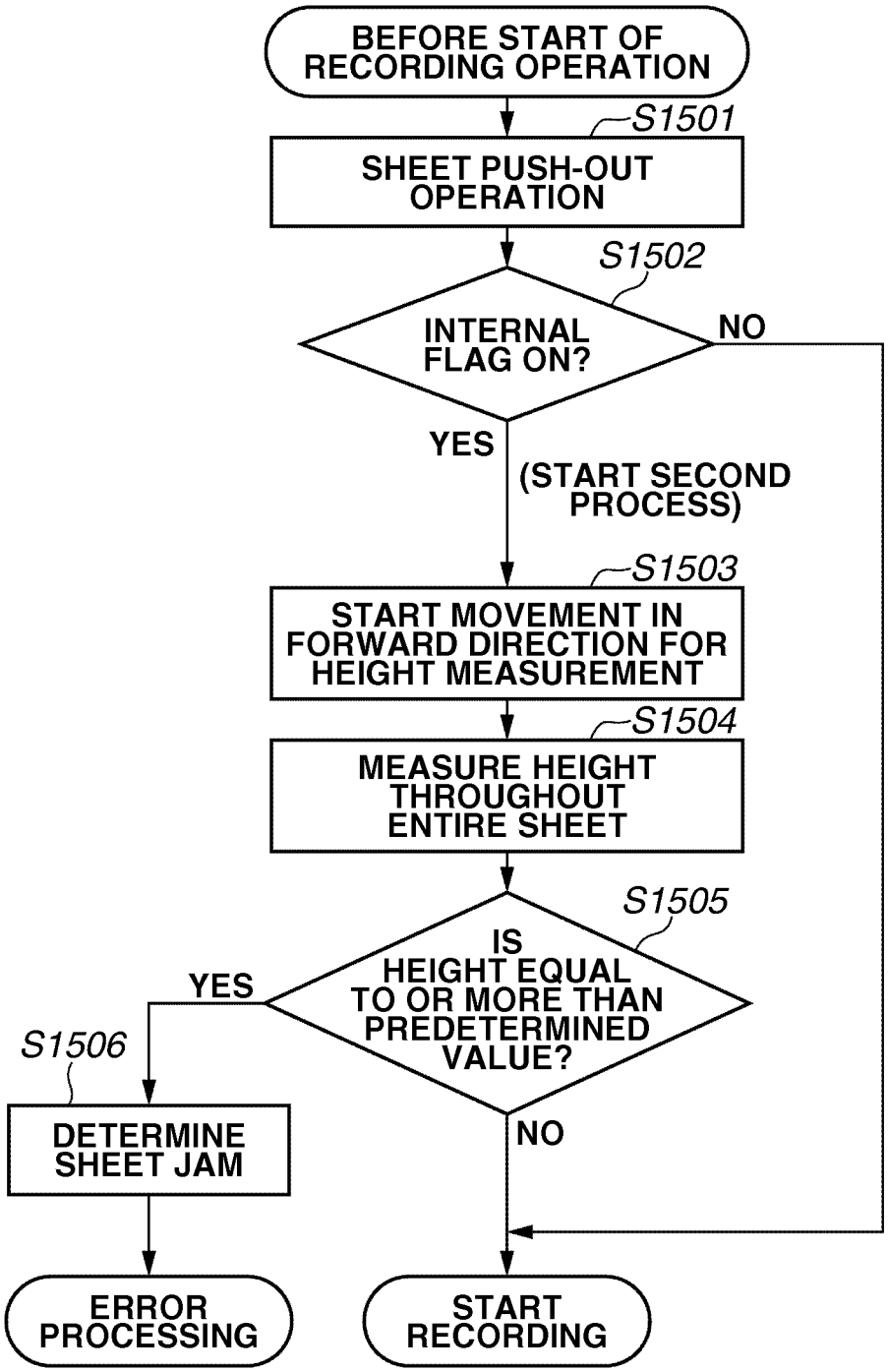
FIG. 15 is a flowchart illustrating execution of the second process for detecting the height data after execution of a conveyance operation for pushing out the cut portion of the recording medium on which an image has been recorded already.

A sixth exemplary embodiment is configured by adding, to the first exemplary embodiment, a conveyance operation for discharging a recorded portion of the recording medium 106 which is cut by the cutter unit 109 before execution of the second process. FIG. 15 is a flowchart of performing the second process of detecting the height data by the detection unit 102 after a conveyance operation of pushing out the recorded portion, which has undergone the cutting operation of the recording medium 106. Referring to FIG. 15, after the above-described first process of detecting a change amount of the distance to the recording medium 106 during a cutting operation, in step S1501, the recording apparatus performs a push-out operation of the recording medium 106. This push-out operation is an operation of pushing out the portion, which is cut off, by further conveying the recording medium 106 to discharge the cut-off portion of the recording medium 106 from the sheet discharge guide 108.

Further, this push-out operation is an operation of discharging the recorded portion, which is cut off, by the conveyance roller. At this time, the carriage 101 is retracted to the vicinity of the cap which is outside the recording region. Then, in step S1502, the control unit 500 checks the state of the internal flag, in similar manner to step S901 of FIG. 9. If the internal flag remains off (NO in step S1502), the control unit 500 determines that sheet uplift does not occur in the first process, and moves on to a recording operation. On the other hand, if the internal flag is turned on (YES in step S1502), the control unit 500 starts the second process. Then, in step S1503, the control unit 500 starts to drive the carriage 101 to move in the arrow C direction. After that, in step S1504, the control unit 500 acquires the height data throughout the entire region of the sheet width by measuring the height throughout the entire region of the sheet width of the recording medium 106 with use of the detection unit 102 while driving the carriage 101 to move.

Next, in step S1505, the control unit 500 determines whether the height data acquired in step S1504 is equal to or more than a predetermined value. If the height data is equal to or more than the predetermined value (YES in step S1505), the process proceeds to step S1506 in which the control unit 500 determines that the recording medium 106 is in a "sheet jam" state which is sheet uplift significant enough to cause damage to the recording head 103, and the error processing is performed. On the other hand, if the height data is less than the predetermined value (NO in step S1505), the control unit 500 determines that the recording medium 106 is in a normal state, and then starts a recoding operation. The present exemplary embodiment is different from the first exemplary embodiment in terms of the above-described features, but other than that, the present exemplary embodiment is structurally similar to the first exemplary embodiment.

According to the present exemplary embodiment, it is possible to perform an operation for detecting a state of the recording medium 106 equalized by a conveyance operation, by the detection operation after the operation for discharging the recorded portion, which is cut off, of the recording medium 106. As a result, it is possible to prevent false detection of "abnormality" when the sheet uplift state is resolved and a normal state is established after the first process. Therefore, it becomes possible to more efficiently prevent a recording failure that might otherwise be caused due to an abnormal state, by accurately detecting whether the conveyance state of the recording medium 106 is abnormal without reducing throughput of a recording operation with use of an easy method.

Figure 16:
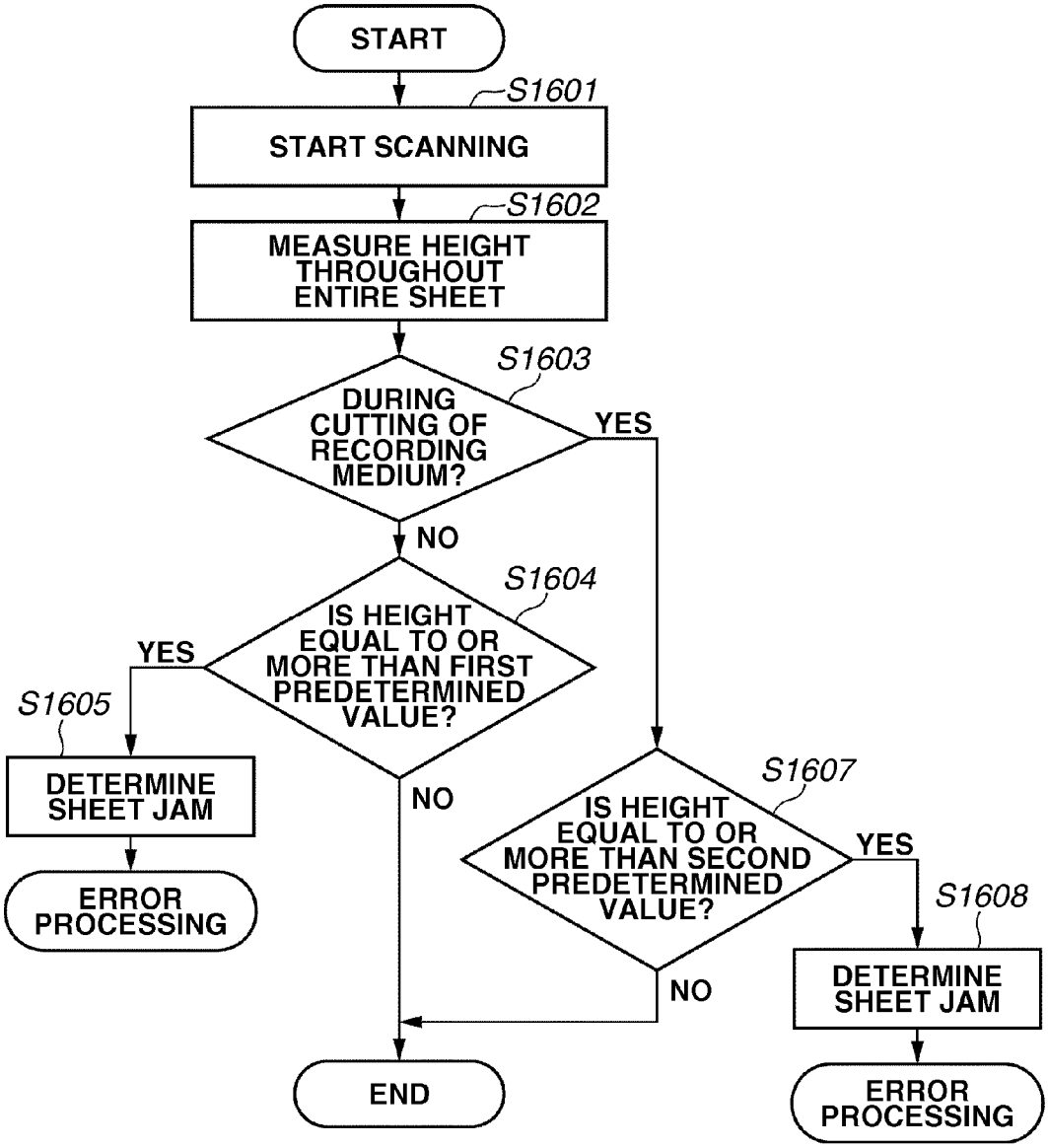
FIG. 16 is a flowchart of a seventh exemplary embodiment of the present invention.

In the above-described exemplary embodiments, abnormal sheet uplift is determined by performing the first and second processes. However, the recording apparatus may simply have different values as a threshold value for determining an abnormality in the height of the recording medium 106 during a cutting operation using the cutter unit 109 and a threshold value for determining an abnormality in the height of the recording medium 106 during a non-cutting operation. In this case, when the recording medium 106 is scanned without being cut, an abnormality is determined if the measurement result indicates that the distance from the recording head 103 to the recording medium 106 is equal to or smaller than a first threshold value so as to cause damage to the recording medium 103. When the recording medium 106 is being cut by the cutter unit 109, an abnormality is determined if the measurement result indicates that the distance from the recording head 103 to the recording medium 106 is equal to or smaller than a second threshold value that is smaller than the first threshold value. The second threshold value is set in consideration of the change in the posture of the carriage 101 that might be caused during a cutting operation. FIG. 16 is a flowchart illustrating a seventh exemplary embodiment. In step S1601, scanning of the carriage 101 is started. Then, in step S1602, the detection unit 102 measures the height throughout the entire region of the recording medium 106. In step S1603, it is determined whether the scanning is performed to cut the recording medium 106. If the scanning is not performed to cut the recording medium 106 (NO in step S1603), the processing proceeds to step S1604, in which it is determined whether the height of the recording medium 106 is equal to or more than a first predetermined value. In other words, it is determined whether the distance from the recording head 103 to the recording medium 106 is equal to or less than a first threshold value. In other words, it is determined whether the distance from the detection unit 102 to the recording medium 106 is equal to or less than a first distance. If the height of the recording medium 106 is less than the predetermined value (NO in step S1604), the processing is ended. On the other hand, if it is determined in step S1604 that the height of the recording medium 106 is equal to or more than the first predetermined value (YES in step S1604), the processing proceeds to step S1605, in which a sheet jam is determined, and then the error processing is performed. If it is determined in step S1603 that the scanning is performed to cut the recording medium 106 (YES in step S1603), then the processing proceeds to step S1607 in which it is determined whether the height of the recording medium 106 is equal to or more than a second predetermined value. If the height is less than the second predetermined value (NO in step S1607), this means that the distance from the recording head 103 to the recording medium 106 is more than the second threshold value, and therefore the processing is ended. On the other hand, if it is determined in step S1607 that the height is equal to or more than the second predetermined value (YES in step S1607), the processing proceeds to step S1608 in which a sheet jam is determined, and then the error processing is performed.

The above-described exemplary embodiments can also be applied in a similar manner regardless of the number of recording heads, the type and shape of ink used, and can also be applied in a similar manner for recording media made of various different materials such as paper, a plastic film, printing paper, and an unwoven fabric.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-039728 filed Feb. 25, 2010, which is hereby incorporated by reference herein in its entirety.

What is claimed is:

1. A recording apparatus comprising:

a recording head configured to record an image on a recording medium;

a carriage with the recording head mounted thereon and configured to make a reciprocating movement;

a cutter unit mounted on the carriage and configured to cut the recording medium;

a detection unit mounted on the carriage and configured to detect a distance to the recording medium; and a control unit configured to perform a first process, wherein in the first process, the detection unit detects the distance to the recording medium while the carriage moves to cut the recording medium by the cutter unit, wherein in case the amount of a change in the distance detected by the detection unit within a range in a direction of the movement of the carriage is equal to or more than a threshold value, the control unit performs a second process, in the second process the detection unit detects the distance to the recording medium by the detection unit while the carriage moves and the cutter unit is retracted, and wherein the control unit determines that the state of the recording medium is abnormal when the distance to the recording medium detected in the second process is equal to or less than a predetermined value.

2. The recording apparatus according to claim 1, further comprising a platen capable of attracting the recording medium by a suction force as a platen supporting the recording medium at a position opposing the recording head, wherein the suction force of the platen in the second process is changed according to a type of the recording medium or an ambient environment.

3. The recording apparatus according to claim 1, wherein the detection unit is disposed between the cutter unit and the recording head in a direction of the movement of the carriage.

4. The recording apparatus according to claim 1, wherein, in the detection of the distance change amount in the first process, a detection result within a predetermined range from a start of the cutting by the cutter unit is not used for the determination whether the state of the recording medium is abnormal.

5. The recording apparatus according to claim 1, wherein a conveyance operation is performed to discharge a recorded portion cut by the cutter unit, after execution of the first process and before execution of the second process.

6. The recording apparatus according to claim 1, wherein a recording operation is started if it is determined in the second process that the state of the recording medium is not abnormal.

7. The recording apparatus according to claim 1, wherein the control unit determines that the state of the recording medium is normal in case the amount of the change in the distance detected by the detection unit within the range in the direction of the movement of the carriage, is equal to or more than the threshold value.

8. A recording apparatus comprising:

a recording unit configured to record an image on a recording medium;

a carriage configured to make a reciprocating movement;

a cutter unit mounted on the carriage and configured to cut a recording medium;

a detection unit mounted on the carriage and configured to detect a distance to the recording medium; and a control unit configured to perform a first process and a second process, wherein in the first process, the detection unit detects the distance to the recording medium while the carriage moves to cut the recording medium by the cutter unit, wherein in the second process, the detection unit detects the distance to the recording medium while the carriage moves and the cutter unit is retracted, wherein in case the amount of a change in the height of a surface of the recording unit, obtained based on the distance detected in the first process within a range in a direction of the movement of the carriage, is equal to or more than a threshold value, the control unit performs a second process, and wherein the control unit determines that the state of the recording medium is abnormal when a height obtained based on the distance detected in the second process is equal to or larger than a predetermined value.

9. The recording apparatus according claim 8, wherein the control unit does not perform the second process in case the amount of the change in the height of a surface of the recording unit is less than the threshold value.

10. The recording apparatus according claim 9, wherein the control unit determines that the state of the recording medium is normal in case the amount of the change in the height of a surface of the recording unit is less than the threshold value.

11. A recording apparatus comprising:

a recording unit configured to record an image on a recording medium;

a carriage configured to make a reciprocating movement;

a cutter unit mounted on the carriage and configured to cut the recording medium;

a detection unit mounted on the carriage and configured to detect a distance to the recording medium; and a control unit configured to perform a first process and a second process, wherein in the first process, the detection unit detects the distance to the recording medium while the carriage moves to cut the recording medium by the cutter unit, wherein in the second process, the detection unit detects the distance to the recording medium while the carriage moves and the cutter unit is retracted, and wherein the control unit performs the second process in case that the control unit determined that an outcome from detection in the first process is abnormal.

12. The recording apparatus according claim 11, wherein the control unit determines that the state of the recording medium is abnormal when an outcome from detection in the second process is abnormal.

13. The recording apparatus according claim 12, wherein the control unit does not perform the second process in case that the control unit determined that an outcome from detection in the first process is normal.

14. The recording apparatus according claim 11, wherein the control unit determines that the state of the recording medium is normal in case that the control unit determined that an outcome from detection in the first process is normal.

* * * * *